US008766904B2

(12) United States Patent
Neal

(10) Patent No.: US 8,766,904 B2
(45) Date of Patent: Jul. 1, 2014

(54) METHOD OF MODELING THE LIGHT FIELD CREATED BY A LOCAL-DIMMING LED BACKLIGHT FOR AN LCD DISPLAY

(75) Inventor: Greg Neal, Morgan Hill, CA (US)

(73) Assignee: STMicroelectronics, Inc., Coppell, TX (US)

( * ) Notice: Subject to any disclaimer, the term of this patent is extended or adjusted under 35 U.S.C. 154(b) by 627 days.

(21) Appl. No.: 12/727,020

(22) Filed: Mar. 18, 2010

(65) Prior Publication Data

US 2011/0227940 A1 Sep. 22, 2011

(51) Int. Cl.
*G09G 3/36* (2006.01)

(52) U.S. Cl.
USPC ..... 345/102

(58) Field of Classification Search
CPC ..... G09G 3/36; G09G 5/02
USPC ..... 345/87, 102, 76, 89
See application file for complete search history.

(56) References Cited

U.S. PATENT DOCUMENTS

| | | | | |
|---|---|---|---|---|
| 8,223,116 | B2 * | 7/2012 | Lee et al. | 345/102 |
| 2006/0061538 | A1 * | 3/2006 | Dispoto et al. | 345/102 |
| 2007/0152926 | A1 * | 7/2007 | Kwon | 345/82 |
| 2009/0021469 | A1 * | 1/2009 | Yeo et al. | 345/102 |
| 2009/0135108 | A1 * | 5/2009 | Lindfors et al. | 345/76 |
| 2009/0303167 | A1 * | 12/2009 | Mori et al. | 345/89 |
| 2010/0103089 | A1 * | 4/2010 | Yoshida et al. | 345/102 |

* cited by examiner

*Primary Examiner* — Pegeman Karimi
(74) *Attorney, Agent, or Firm* — Beyer Law Group LLP

(57) ABSTRACT

A controller for an LCD display is described. The controller can control an LED backlight that includes an array of LED lighting elements and an LCD panel that includes a number of pixels. The controller can modulate an individual or groups of the lighting elements in the LED backlight, such as dimming lighting elements, to control a light-field emitted from the LED backlight. The modulation of the lighting elements, such as dimming, can improve image contrast ratios that are generated using the LCD display. Methods and apparatus are described that can simplify calculations used to determine 1) the light-field generated by the LED backlight and 2) a correction factor for adjusting pixel data. The correction factor can be used to adjust an amount of light transmitted by each pixel in the LCD panel to compensate for the backlight producing a light-field that is brighter in some areas and dimmer in other areas.

16 Claims, 7 Drawing Sheets

METHOD OF MODELING THE LIGHT FIELD CREATED BY A LOCAL-DIMMING LED BACKLIGHT FOR AN LCD DISPLAY

FIELD OF THE INVENTION

The invention relates to back-lighting of display devices such as liquid crystal displays (LCDs). More specifically, the described embodiments described at least systems, methods, and apparatus suitable for providing contrast ratio improvement for LCD displays having a Light-Emitting Diode (LED) array backlight.

BACKGROUND OF THE INVENTION

Liquid crystal displays (LCDs) are increasingly being used for the display device in televisions, personal computers, etc., and in much state-of-the-art equipment such as automotive navigation systems and simulation devices. One area in particular where LCD's are increasingly being utilized is flat panel televisions. With the general acceptance of the flat panel TV technology by the markets there has been a large marketing and technology war over which technology is the best, such as plasma display technology versus LCD display technology. Flat panel televisions can be judged on their over all "thinness," their weight, price, product lifetime and their image quality. Certain display technologies can be better in one area, such as image quality but be worse in other areas, such as weight or price.

Typically, the image quality of content output by a particular display technology is one of the most important factors taken into consideration when a buyer purchases a flat panel television. There are many different criteria to judge image quality. Two important criteria are contrast ratio and black level reproduction. In the past, the "contrast ratio" and black level reproduction of plasma displays have been better than that of LCDs and hence Plasmas displays have often been judged to have better image quality reproduction than LCDs.

An image is generated on an LCD by controlling the amount of light that can pass through an LCD material. The light can be provided by a backlight located on one side of the LCD where the image is viewed from the other side of the LCD opposite the backlight. Typically, the LCD material can include a large number of pixels arranged in an array where the pixels can be individually controlled to affect an amount of light that passes through the LCD material. The pixel control can reproduce a desired image.

One limitation of LCDs is that it is difficult to completely turn off a pixel at a particular location like in a cathode ray tube (CRT). In a CRT, the electron beam can almost be completely turned at a particular location to generate a deep black. In an LCD, a typically image includes light and dark pixel areas. When the backlight remains on to light the lighted pixel areas of the image, light can also bleed through the dark pixel areas, which limits the "blackness" in the dark pixel areas. One approach to improving the black levels in an LCD panel is to better block the light that leaks through the LCD panel when a pixel is supposed to display black levels. Light blocking technology is complicated and its success has been limited. Thus, it would be desirable to provide alternative methods and apparatus, i.e. besides or in conjunction with the light blocking technology, that can be used to improve image quality, such as contrast ratio, generated using an LCD display.

SUMMARY OF THE DESCRIBED EMBODIMENTS

The embodiments described herein relate to controller for an LCD display. The controller can control an LED backlight that includes an array of LED lighting elements and an LCD panel that includes a number of pixels. The LED backlight illuminates the pixels to display an image on the LCD display. The controller can determine lighting levels for each of the LEDs in the LED backlight to provide a light-field from the backlight that varies in intensity across the LCD panel. The determination of the light levels can be based upon image data that is to be output on the LCD panel. The light levels in the backlight can be modulated in different areas, such as dimmed, to reduce light bleed in areas where the image data that is to be output is dark. The dimming can improve contrast ratios and provide darker "darks" when the image is viewed on the LCD display.

When one or more zones of the backlight are dimmed, the distribution of light provided to the LCD panel is altered. The changed light distribution can affect the illumination of each pixel of the LCD panel. Without correction, the changed light distribution from dimming one or more zones of the backlight can lead to portions of an image displayed on the LCD panel appearing brighter in some areas relative to other areas because some areas of the LCD panel receive more light from the backlight than other areas. To reduce this effect, the light transmitted by the individual pixels of the LCD panel can be adjusted in real-time based upon a particular setting of the backlight. Adjusting the individual pixels can involve changing a pixel setting associated with each pixel to allow more or less light emitted by the backlight to be transmitted by the pixel through the LCD panel.

One aspect provides in a liquid crystal display (LCD) controller a method controlling a backlight and a LCD panel. The method can be generally characterized as comprising: receiving image data comprising a plurality of frames; determining, using at least the received image data, a lighting level for each of a plurality of zones in the backlight wherein each zone includes one or more light-emitting diodes (LEDs); driving each of the plurality of zones according to its determined lighting level; determining a pixel setting for each of a plurality of pixels in the LCD panel based upon an estimated amount of light reaching each of the plurality of pixels from the backlight; and configuring the LCD panel with the pixel settings to display an image associated with the image data.

Another aspect provides an apparatus for displaying images. The apparatus can generally characterized as comprising: an LCD panel comprising a plurality of pixels for displaying the images; an LED backlight including a plurality of zones for illuminating the LCD panel wherein each of the plurality of zones includes one or more LEDs; a controller, coupled to the LCD panel and the LED backlight. The controller can be designed or configured to 1) receive image data comprising a plurality of frames; 2) determine, using at least the received image data, a lighting level for each of a plurality of zones in the backlight; 3) drive each of the plurality of zones according to its determined lighting level; and 4) determining a pixel setting for each of a plurality of pixels in the LCD panel based upon an estimated amount of light reaching each of the plurality of pixels from the backlight; and 5) configuring the LCD panel with the pixel settings to output the displayed images associated with the image data.

Yet another aspect provides an integrated circuit. The integrated circuit can be generally characterized as comprising: a zone brightness setting determiner block; a grid brightness calculator block; and a processor in communication with the zone brightness setting determiner block and the grid brightness calculator block. The processor can be arranged to improve a contrast ratio of image displayed on an LCD by determining a lighting level for a plurality of LEDs in a backlight of the LCD and by determining a light-field generated from the backlight at each pixel location of an LCD panel.

DETAILED DESCRIPTION OF SELECTED EMBODIMENTS

Figure 1A:
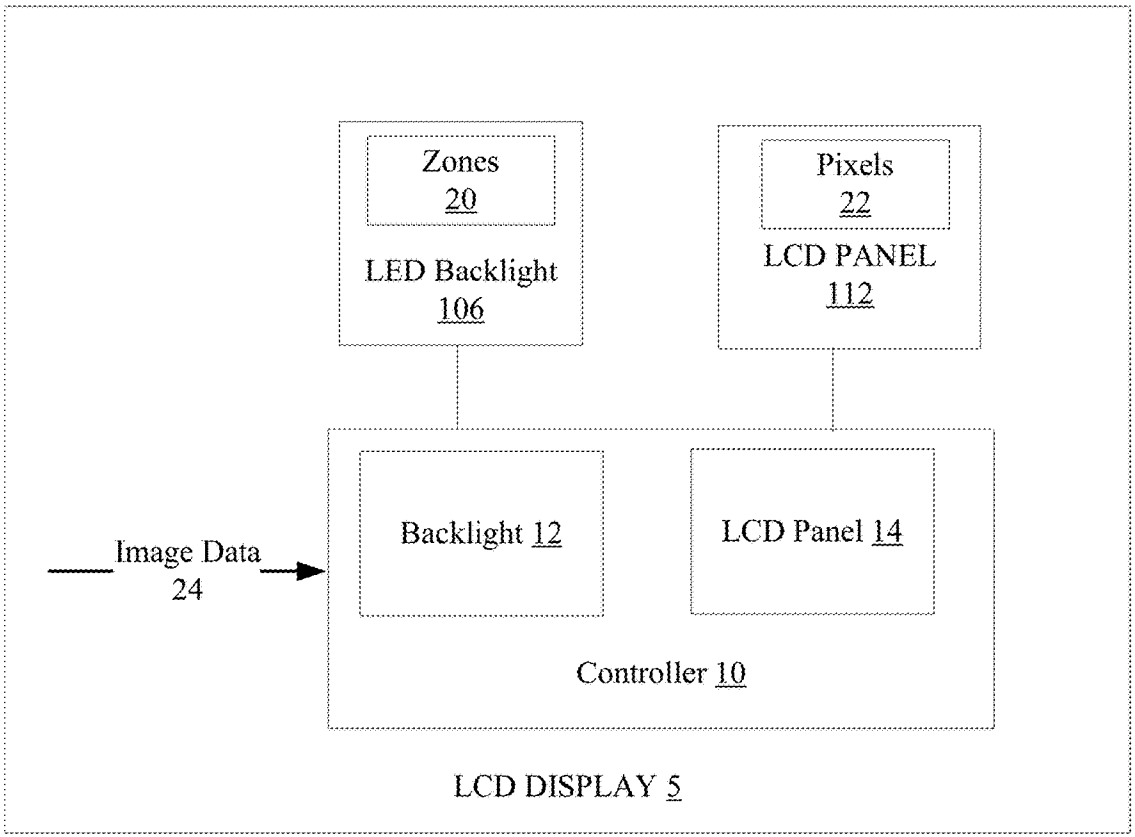
FIG. 1A illustrates a block diagram of a LCD display in accordance with the described embodiments.

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

The embodiments described herein relate to methods and apparatus for improving contrast ratio and providing darker "darks" output by an LCD display. The LCD display can include an LCD panel, a backlight and a controller (e.g., see FIG. 1A). The backlight can include an array of LEDs arranged in zones. The LCD panel can include a number of pixels that are illuminated by the backlight to display an image. The pixels in the LCD panel and the zones in the backlight can be controlled by the controller (see FIGS. 3 and 6).

The controller can be configured to selectively dim or turn-off LEDs in one or more zones of the backlight (see FIGS. 1A-C and 3). The dimming can reduce light bleed associated with pixels in the display panel. The reduced light bleed can improve the contrast ratio and provide darker "darks" when an image is displayed on the LCD display is viewed. Each zone of the backlight can be associated with a portion of the LCD panel (see FIGS. 1B, 1C and 2). The determination of whether to dim a zone can be based upon an analysis of image data to be displayed in a portion of the LCD panel associated with each zone (see FIGS. 2, 3 and 4).

When one or more zones of the backlight are dimmed, the distribution of light provided to the LCD panel is altered. The changed light distribution can affect the illumination of each pixel of the LCD panel (see FIGS. 1A and 1B). Without correction, the changed light distribution from dimming one or more zones of the backlight can lead to portions of an image displayed on the LCD panel appearing brighter in some areas relative to other areas because some areas of the LCD panel receive more light from the backlight than other areas. To reduce this effect, the light transmitted by the individual pixels of the LCD panel can be adjusted in real-time based upon a particular setting of the backlight. For instance, when a portion of the LCD panel receives less light because a portion of the backlight has been dimmed, individual pixels proximate to this region can be darkened or brightened to allow more light to be transmitted through the LCD panel. The adjustment of the individual pixels to account for changing light distributions emitted from the backlight can be referred to as a pixel correction factor. The controller can be configured to perform this calculation (see FIG. 3).

The determination of the pixel correction factor can involve determining the light distribution across the display panel at each pixel location on the display panel. This calculation can be numerically intensive because each zone contributes light to each pixel location. In one embodiment, to reduce the number of required calculations, the calculations can be performed on a grid that is coarser than the pixel resolution of the LCD panel (see FIGS. 2 and 3). In a particular embodiment, the zones of the backlight can be driven asynchronously, i.e., the light setting in each zone can be updated in different zones at different times, which can affect the light distribution provided by the display panel. The determination of the light distribution across the LCD panel can be modified to account for asynchronous updates of the light setting in each zone (see FIG. 5)

FIG. 1A illustrates a block diagram of a LCD display 5 in accordance with the described embodiments. The LCD display 5 can include a controller 10, an LED backlight 106 and an LCD panel 112. The LED backlight 106 can include a number of LED arranged in zones 20. Each zone can include one or more LEDs. The LEDs in each zone can be individually controlled to allow an amount of light emitted from each zone to be varied from zone to zone. The backlight portion 12 of controller 10 can be used to determine light levels for each zone.

The LED backlight 106 can illuminate the LCD panel 112. The LCD panel 112 can include a number of pixels 22. At each pixel location on the LCD Panel 112, the "opaqueness" of each pixel can be controlled to affect an amount of light emitted from the LED backlight 106 that is transmitted through the LCD panel at each pixel location. The "opaqueness" of each pixel can be controlled by the LCD panel 14 portion of the controller 10. A control signal generated by the controller 10 used to configure the opaqueness of each pixel in the LCD panel can be referred to as a pixel setting. By varying the pixel setting of each of the pixels 22, an image can be formed on the LCD panel 112. The image formed using the pixels 22 and the associated pixel setting for each pixel can be determined from the image data 24, such as a television signal, received by the controller 10.

The amount of light emitted through the LCD panel 112 at each pixel location can depend on how opaque a pixel is to light and an amount of light emitted from the backlight that reaches the pixel location from each zone of the backlight 106. Thus, the amount of light of light emitted through the LCD panel at a pixel location can be changed by 1) changing an amount of light reaching a particular pixel location from the backlight or 2) changing the opaqueness of the pixel at the particular pixel location. Methods and apparatus that modify these quantities to improve contrast ration and backlight brightness are described with respect to the following figures.

Figure 1C:
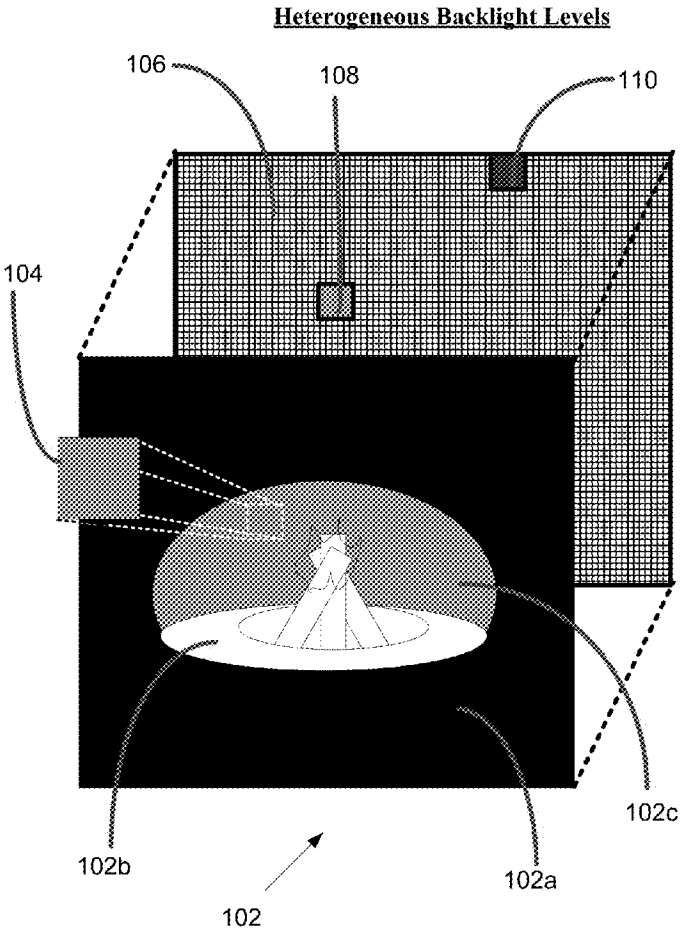
FIGS. 1B and 1C illustrate an LCD panel and a LED backlight where LED backlight lighting levels and pixel data are controlled in accordance with the described embodiments.
Figure 1B:
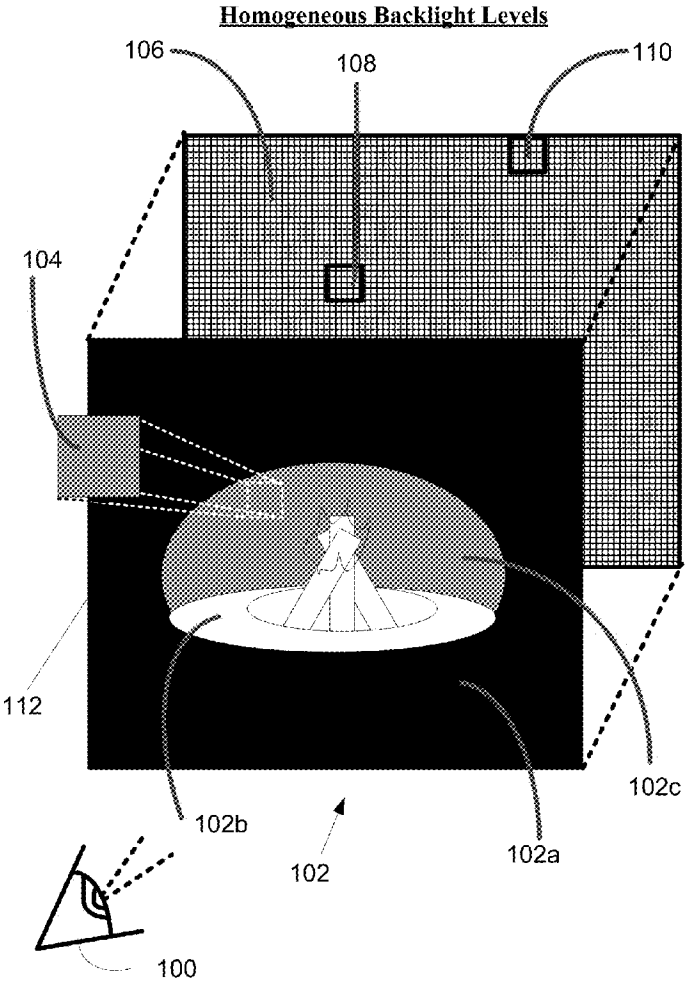

FIGS. 1B and 1C illustrate an LCD panel 112 and a LED backlight 106 where LED backlight lighting levels and pixel data can be controlled in accordance with the described embodiments. The LCD panel 112 can include a number of pixels, such as 104, that can be individually configured using data that corresponds to a particular image. Each pixel can include a number of controllable sub-pixels that allow various colors to be generated. The pixels can be arranged in rectangular array where a product of the number of pixels along each dimension of the rectangular array can correspond to a resolution of the LCD display. The number of pixels in each direction can depend on a display aspect ratio.

In FIG. 1B, an image of a firepit at night is displayed as pixel data 102 on the LCD panel. When a backlight, such as 106, is illuminated, the image generated on the LCD panel can be viewed at a particular viewing angle, such as 100. The pixel data can be generated from the image data. The pixel data can include dark areas, such as 102*a*, bright areas such as 102*b*, and areas in between bright and dark, such as 102*c*.

The backlight 106 can include a number of lighting elements, such as a number of LEDs. As described with respect to FIG. 1A-1C, the lighting elements can be controlled in zones, such as 108*a* and 110*a*. A zone can include a single lighting element or a group of lighting elements. A controller can be used to control the lighting elements in each zone. For instance, the backlight controller can provide one or more control signals that can be used to set a lighting level for each zone, such as completely turning off a portion or all of the lighting elements in a zone.

At different times or in particular embodiments, the zones and their associated lighting elements can be controlled to emit light in a homogeneous or a heterogeneous manner. When the zones are controlled in a homogeneous manner, the light distribution provided by the backlight can be relatively homogeneous or "even" across the display panel. In FIG. 1B, the zones, such as 108 and 110 are controlled in a homogeneous manner and all of the zones are configured to emit an equal amount of light. When the zones are controlled in a heterogeneous manner, the light level emitted from each zone can vary from zone to zone and the light distribution provided by the backlight can be brighter in some areas or dimmer in other areas. Thus, the light distribution across the display panel is heterogeneous. In FIG. 1C, zones 108 and 110, are each dimmed relative to their neighboring zones. In particular, zone 110 is dimmed more than zone 108.

The lighting level of each zone, such as 108 and 110, can change over time. In particular embodiments, the lighting level for each zone can be determined from image data, which can change over time. Thus, the brightness of a particular zone can change over time depending on the image data that is to be displayed as will be discussed further below. The number of zones that are controlled and the lighting levels of the zones in FIGS. 1B and 1C are provided for the purposes of illustration only. For instance, other zones can be defined around 108*b* and 110*b* that can also be controlled.

As noted above, the lightning level for each zone can depend on image data that is to be displayed to the LCD panel 112. Zone 108 can be associated with image data related to pixel 104. The image data associated with pixel 104 is darker than the areas near the fire but not as dark as image data farther away from the fire. Thus, zone 108 can be dimmed to improve the contrast ratio proximate to pixel 104. Zone 110 can be associated with image data that is mostly dark. Zone 110 can be dimmed more than zone 108 to produce an even greater contrast level and a darker dark.

When the lighting level of a zone is changed, such as a zone is dimmed, a pixel correction factor can be used to modulate the digital pixel data to compensate for the changed amount of light emitted from the backlight. The pixel correction factor can be used to preserve the average brightness of the pixel when it is viewed. For instance, when the amount of light emitted from the backlight is reduced by a certain percentage at a certain location, a brightness of the pixel data associated with this location can be increased by the same amount as the dimming to the preserve the average brightness of the pixel as viewed from a front of the display. When a pixel is brighter in an LCD panel, it can allow more light to be transmitted through the panel.

In more detail, zone 108 the original backlight intensity value can be $BLI_1$. In one embodiment, $BLI_1$ can initially be a maximum intensity value, such as a value with no dimming, but it can also be an intermediate intensity value as well. The value of an associated pixel, such as 104, can be $PV_1$. The value of the pixel can determine how much light and a color of the light that is to be transmitted through the pixel embedded in the LCD panel 112. After a backlight light intensity value, $BLI_1$, and the pixel value, $PV_1$, are selected, the light intensity of the display that is output via pixel 104 can be measured. An intensity value of the measured light that is output can be referred to as the light intensity at the pixel location, $LI_1$.

The content of a video signal that is to be displayed at a pixel, such as 104, can be used to adjust the LED backlight in a Zone, such as 108 or 110. The amount of the adjustment, such as an increase or decrease of a certain amount can be referred to as "k." An objective of performing the adjustment associated with "k" can be to decrease an intensity value of the backlight, i.e., dimming. Dimming can improve black level reproduction and contrast ratio in the pixel areas proximate to the dimmed zones. The backlight can be adjusted in a number of different zones of the LED backlight array. For instance, the backlight can be decreased or dimmed in zones where there are no bright pixels associated with the image data from the video signal.

As an example, the content of the video signal that is backlit by zone 108, i.e., the content displayed on pixel 104, corresponds to a darker area of the image. The image is darker in this area because it is away from the fire, which is the primary light source in the image. The backlight intensity value in zone 108 can be reduced. The new backlight intensity value in zone 108 can be $BLI_2$. Once the backlight intensity is decreased to $BLI_2$ in zone 108, the light intensity output at pixel location 104 can decrease to $LI_2$ because less light is being emitted from the backlight proximate to the pixel location 104.

In one embodiment, to maintain the original look of the image, the light intensity output before and after the backlight adjustment can be approximately preserved at every pixel location. For instance, preserving the light intensity output at pixel location 104, as described above, can be performed by attempting to maintain $LI_2$ at pixel 104 to be equal to $LI_1$ at pixel 104. To maintain the light intensity output at the different backlight intensities, the pixel values, such as the pixel value at 104 can be changed at each pixel location. In particular, the pixel values at each pixel location such as 104 can be changed by an amount that accommodates the change in backlight intensity levels.

As a simplified example, at a particular pixel location, such as 104, the initial light intensity $LI_1$ output at the particular pixel location can be defined by the pixel value $PV_1$ and backlight intensity value $BL_1$ such that $LI_1=(PV_1)(BL_1)$. The new light intensity output at the pixel location after the backlight intensity value is decreased can be defined as $LI_2=$ $(PV_2)(BL_2)$. To maintain the light intensity output, $LI_2$ can be set equal to $LI_1$ which yields, $$(PV_2)(BL_2)=(PV_1)(BL_1).$$

Solving for $PV_2$ yields, $$PV_2=(PV_1)(BL_1)/(BL_2)=PV_1/k$$

where "k" is the adjustment made to the pixel value described above. Applying this simplified formula to a single zone and a single pixel associated with the zone, if the backlight in the zone is decreased by 20%, then $BL_2=0.8\ BL_1$ and $1/k=1.2$. Thus, $PV_2=1.2\ (PV_1)$, i.e., the pixel value can be increased by 20% to maintain the light intensity output at the pixel.

The example above is referred to as simplified because it involves only decreasing the backlight intensity value in one zone. In other embodiments, the backlight intensity can be adjusted in multiple zones simultaneously. Based on the backlight intensity over all of the backlight zones, a correction factor, "k," can be determined for each pixel. After the determination, the pixel value of each pixel can be modified by the correction factor to account for light originating from other zones. Method and apparatus for determining correction factor in this manner are described as follows.

The amount of stray light originating from other zones within backlight can be measured, stored and processed at full panel resolution (on a pixel-by-pixel basis) to determine the correction factor. However, the amount of hardware resources to accomplish this task can be significant in terms of gate count, die size, cost and processing power. In one embodiment, to reduce the size of the required hardware resources to determine the correction factor, instead of working at full panel resolution, a sub-grid with a lower resolution can be used for the calculation.

The correction factor calculations on the sub-grid can be performed by a controller. Details of the controller are described with respect to FIG. 3. In one embodiment, the sub-grid dimensions that are utilized by the controller can be fixed. In another embodiment, the sub-grid dimensions can be a parameter that can be set. In yet another embodiment, calculations can be performed without the use of a sub-grid. The use of a sub-grid can reduce a precision associated with calculating the correction factor. A sub-grid size can be selected based upon an amount of hardware resources and processing power is available and a desired level of precision in the calculation.

Figure 2:
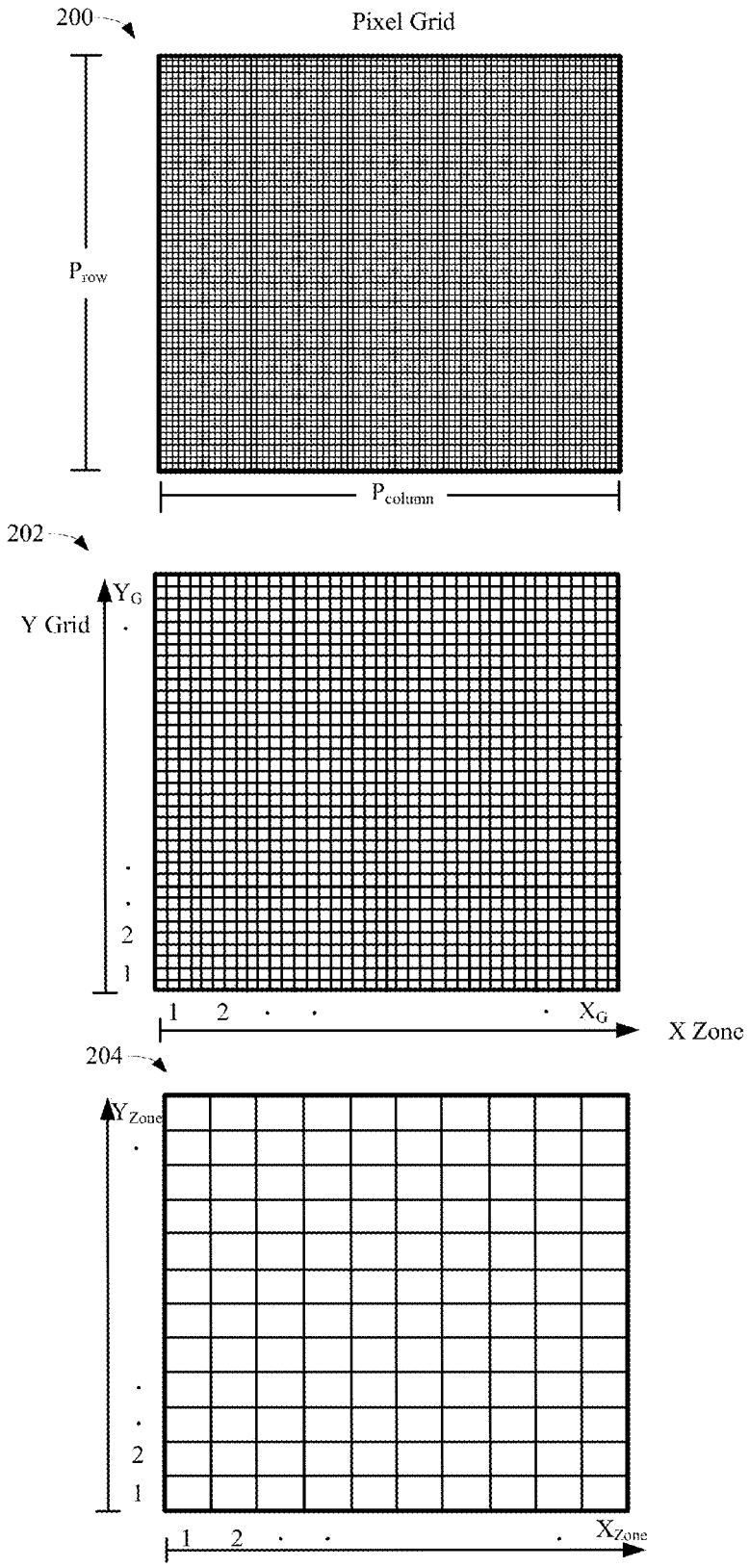
FIG. 2 shows a pixel grid, a correction factor calculation grid and a zone control grid in accordance with described embodiments.

FIG. 2 shows a pixel control grid 200, a correction factor calculation grid 202 and a zone control grid 204. The pixel control grid can represent a number of pixels that are controlled in the LCD panel. The pixels can be arranged in rows and columns with a number of rows, $P_{row}$, and a number of columns, $P_{column}$, where the total number of pixels controlled is the product of $P_{row}$ and $P_{column}$.

The zone control grid 204 can represent a number of zones in the backlight that are controlled. Each zone can represent a region of the backlight unit. In one embodiment, it can be assumed that each zone has a uniform light output. The number and shape of each zone can be determined by the number of light sources in the backlight unit and the way the light sources are grouped, such as the number and grouping of LED light sources. In a particular embodiment, each zone can be driven by with a single control signal. The control signal for each zone can correspond to a desired illumination level for the entire zone. The zones can arranged in rows and columns with a number of rows, $Y_{zone}$, and a number of columns, $X_{zone}$, where the total number of zones controlled is the product of $X_{zone}$ and $Y_{zone}$.

The correction factor calculation grid 202 can represent a number of locations where the correction factor calculation is performed. As described above, a correction factor can be calculated to account for modifications, such as dimming, to various backlight zones. At each location on the correction factor calculation grid, the illumination on the display can be modeled based upon contributions of light from each of the backlight zones. This calculation can be used to determine a correction factor. When the correction factor grid 204 includes less resolution than the pixel control grid 200, the correction factors calculated using the correction factor grid 204 can be interpolated to determine correction factors for each pixel.

In one embodiment, a controller can be programmed to utilize a correction factor grid 202 with up to 384 points in the x direction, $X_G$, and 256 points in the Y direction, $Y_G$. As noted above, the number of grid points in the correction factor grid can be less than the number of pixels in each direction. In addition, the controller can be programmed to control a number of backlight zones. In one embodiment, $X_{zone}$ can be up to 24 and $Y_{zone}$ can be up to 16.

Figure 3:
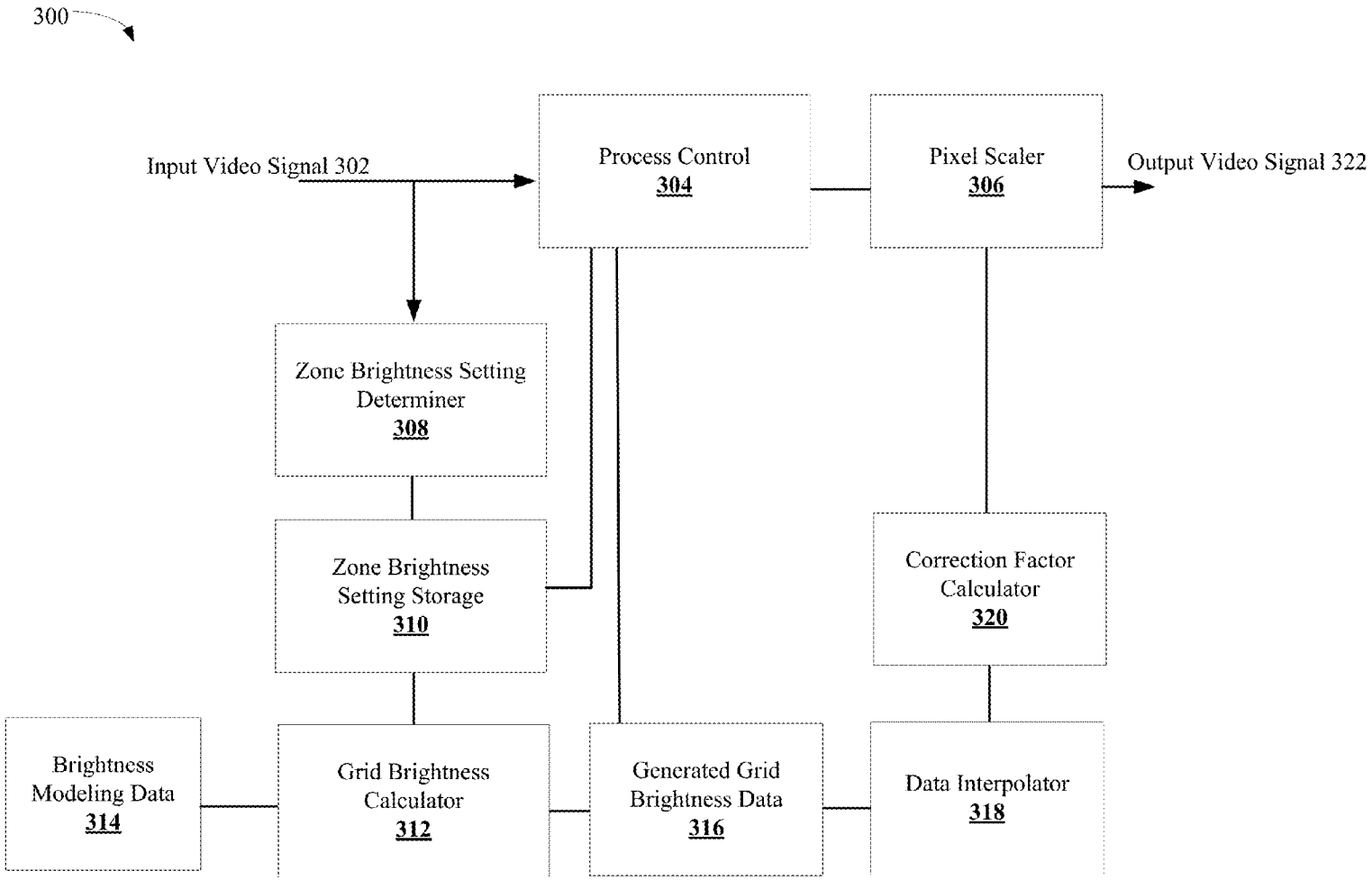
FIG. 3 is a block diagram of a controller in accordance with described embodiments.

In the following figures, a controller for performing the correction factor calculations and more details of the correction factor calculation are described. FIG. 3 is a block diagram of a backlight controller 300 in accordance with described embodiments. The controller is an example of controller 10 described with respect to FIG. 1A. In 302, the controller can receive an input video signal which can include image data for one or more video frames. In one embodiment, the video signal can be a 14-bit RGB double-wide signal.

In particular embodiments, the process control 304 can be configured to define an active area of an outgoing image. It can be programmed with a grid size of the correction factor grid 202 (see FIG. 2). As describe above, in one embodiment, a maximum grid size can 384 columns and 256 rows. The active area can be divided up according the correction factor grid dimensions. It can control the grid brightness calculator 312 and a communication formatter that provides data used to control light sources in the backlight unit (see description of 310 below for more details regarding the communication formatter).

The zone brightness setting determiner 308 can be used to determine a lighting level for each zone of the backlight display based upon received image data. An example of a zone lighting level can be fully-on, partially-on or off. The partially-on setting can comprise a number of intermediate values. The zone brightness determiner 308 can determine a lighting level for a particular zone based upon image content that is to be displayed in the zone. In one embodiment, this determination can be done on a frame by frame basis. Further details of a procedure for determining the lighting level setting for each zone are described with respect to FIG. 4.

The zone brightness setting determiner 308 can send zone lighting levels for a particular frame to storage 310. In a particular embodiment, zone lighting levels can be stored for up to 10 consecutive frames. The storage can include a circular buffer. After one frame is processed by zone brightness setting determiner 308, a memory in the storage 310 can be populated with zone lighting level values. After the memory is filled, a circular buffer pointer can be used to indicate a next memory in the storage to use. The pointer can point to up to 10 memory locations for storing data associated with 10 consecutive frames. As the memory locations in 310 are filled, the pointer can indicate the memory location of the oldest frame data and this memory location can be overwritten. Embodiments using more or less than 10 consecutive frames are possible and a storage unit, such as 310, can be configured to accommodate the storage of a different number of frames.

The generated zone lighting levels that are determined for each frame in storage 310 can be used a communications formatter (not shown). As previously described, in one embodiment, a backlight panel can comprise up to 24 columns and 16 rows of configurable zones. The communication formatter can translate the zone lighting level settings determined for each zone into a format that is understandable by one or more different LED drivers associated in each zone. The LED drivers can generate one or more control signals that determine a lighting level for each LED in the zone.

In various embodiments, the communication formatter can convert zone lighting level information into PWM information (Pulse Width Modulation). In other embodiment, the communication formatter can provide on and of signals at particular time periods. The communication formatter can be configurable to allow it to work with different LED drivers. For instance, the communication can be a separate programmable microcontroller with its own instruction set.

The grid brightness calculator 312 can be configured to determine a light intensity emitted from the backlight at each grid point in the correction factor grid 202 (see FIG. 2). In particular embodiments, the calculation can determine a light intensity level at a particular grid point in the correction factor grid based upon light contributions from each zone of the backlight unit. The calculation can model how the light emitted from a zone fades with distance. In a particular embodiment, a memory 314 can store the modeling data for the calculation.

In one embodiment, the grid brightness calculations can be formulated such that portions of the calculation are decoupled from other portions of the calculation. This decoupling can allow for calculations to be performed in a parallel. For instance, 2 or more columns or 2 or more rows in the correction factor grid can be calculated in parallel. In one embodiment, calculations are performed for up to 16 columns in parallel. Further details of the calculation are described with respect to FIG. 5.

The brightness model data 314 can store the brightness modeling data for each zone. The brightness modeling data can be used to determine a light intensity emitted from the backlight at a particular location. The data that it stores can be modified to account for different model data and a different zonal configuration. In one embodiment, for each zone, it can contain normalized zone brightness data at all the locations of the correction factor grid including within a particular zone and outside of a particular zone. As described above, it can be used by the grid brightness calculator to model how light diminishes with distance at all positions in the correction factor grid around a lit zone.

The grid brightness calculator 312 can output calculation results that are stored as the generated grid brightness data in 316. In one embodiment, 3 rows of the correction factor grid can be stored at one time up to the maximum number of columns per row, such as 384 columns per row as described above. One row of stored data can be used as an accumulator that stores brightness values for an on-going calculation. The other two rows can store calculated brightness values. As described above, a number of these calculations can be performed in parallel, such as but not limited to 16 simultaneous calculations.

The calculated brightness data on the correction factor grid 316 can be used by the data interpolator to determine brightness values at each pixel location. As is described in FIG. 1, the interpolated brightness values can be used to "scale" each pixel value by a correction factor. For example, the correction factor can be used to increase the light output at a pixel location to compensate for backlight dimming.

In one embodiment, the data interpolator can use a 2-D linear interpolation scheme of the 4 grid points on the correction factor grid surrounding a pixel to determine the brightness value for each pixel. A number of interpolation calculations can be performed in parallel, such as 4 calculations. In other embodiments, higher order interpolation schemes involving more the 4 grid points on the correction factor grid can be used. Further, in some interpolation schemes brightness value calculations performed on one or more previous frames or subsequent frames in a sequence of frames can also be used. For instance, the current brightness value of a pixel can be used in determining the next brightness value. In yet other embodiments, the interpolation calculation can be performed once or multiple times for each frame.

Once the data interpolator has calculated the brightness values for each pixel. The correction factor 320 calculator can determine the correction factors for each pixel. The data interpolator 318 calculates the brightness of the backlight at each pixel location. As previously described, the pixel data can be corrected for varying backlight settings, such as backlight dimming, to maintain an overall front-of-screen brightness level. In one embodiment, to avoid a hardware divider, the brightness values can be inverted using an inverse table. The inverted result can be used as a multiplier to the original pixel data to prevent a divide. The inverted result can provide a correct factor to the original pixel data.

The pixel scaler 306 can use the data from the correction factor calculator 320 to determine new pixel values for each of the pixels in a frame of data. For instance, when an inverse table is used in 320, a scale value and a shift value can be provided. The scaled pixels can be output as output video signal 322. The output video signal can be output on the LCD display screen.

As discussed above with respect to FIG. 3, a zone brightness setting determiner 308 can be used to determine a zone brightness setting for each zone. The setting can be determined from image content that is to output to the LCD display. Further details of determining the setting are described with respect to FIG. 4 as follows.

Figure 4:
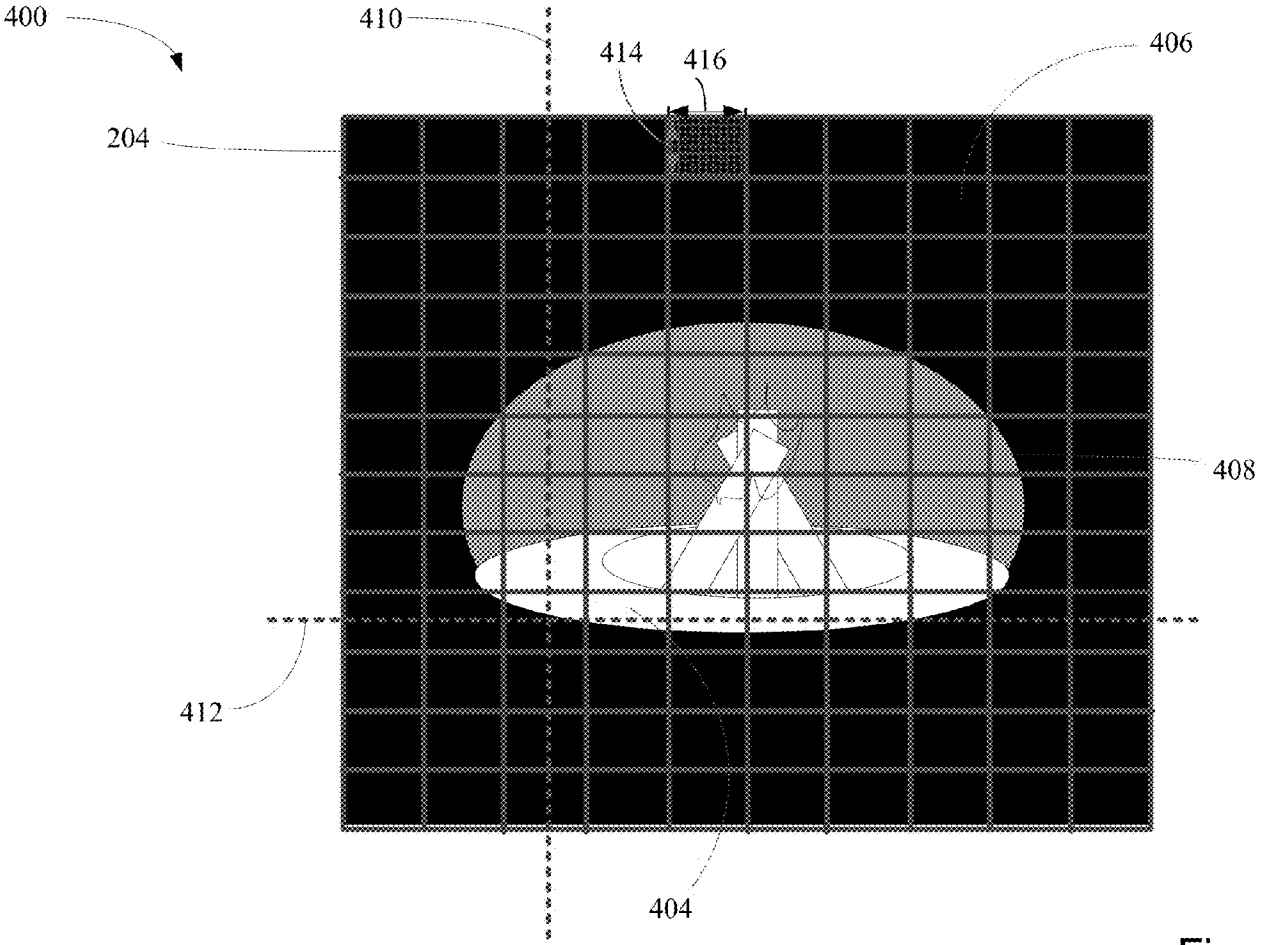
FIG. 4 shows image data overlaid with a zone control grid in accordance with described embodiments.

FIG. 4 shows image data 400 overlaid with a zone control grid 204 (see FIG. 2). The brightness of each zone can be determined and the backlight in each zone can be adjusted based upon the image content in each zone. The image content can be formatted as pixel data of a number of rows and columns. Thus, in each zone of the zone control grid there can be a number of rows 414 and columns 416 of pixel data.

To determine an amount of backlight that is to be used, the content in each zone can be analyzed for light and dark objects. When an entire zone is dark or black, the amount of backlight in the zone can be significantly reduced. When there are bright portions in a zone as well as dark portions, then the backlight may not be dimmed as much to maintain the brightness of the bright portions. When an entire zone is mostly bright, then the backlight can be at its maximum value, i.e., the maximum desired brightness setting for the backlight.

As examples, zone 406 is entirely black. In this zone, the backlight can be significantly reduced. In zone 408, which includes darker areas and a slightly lighter area, the backlight can be reduced but possibly not as much as zone 406. In zone 404, which includes a bright area and a dark area, the backlight may have to be almost fully on because the bright area is of a significant size.

A method for assessing a size and distribution of bright objects within in a particular zone can be as follows. In one embodiment, a measure of brightness for a zone can be calculated separately in the horizontal and vertical direction. In a horizontal direction, the pixel data can be IIR (Infinite Impulse Response) filtered on a line-by-line basis, such as along line 412. The lines can cut across multiple zone columns. Along each horizontal line, the peak value from the IIR filter in each zone can be stored. The maximum peak value for each zone can be used as a measure of the size and brightness of the objects within the zone.

In the vertical direction, on a line-by-line basis, such as along line 410, the absolute maximum value determined from the pixel data can be stored for each zone. The maximum values in each zone can be IIR filtered and then stored. A blend of the two values, i.e., one that measures the brightness distribution in the horizontal direction and one that measures the brightness distribution in the vertical direction, can be used as a reference for calculating the required backlight intensity for each zone.

As discussed above with respect to FIG. 3, the grid brightness calculator 312 can be used to determine the brightness at each grid location in a correction factor grid. The brightness calculation can comprise a summation of the lighting contributions from each zone of an LCD backlight at a point in the correction factor grid. The calculation can involve determining, for each grid point, a distance from the grid point in the correction factor grid to a point in each zone, such as to a zone center. Then, a light contribution at the grid point from the point in each zone can be based upon the brightness setting for the zone and a drop off in the brightness based upon the calculated distance from the point in the zone. In one embodiment, the drop off in the light contribution as a function of distance can be stored as tabular data with the brightness modeling data 314 (see FIG. 3).

The brightness calculation can be used to determine a correction factor for adjusting pixel data that is to be output to the display panel. In one embodiment, the zones of the LCD backlight can be driven asynchronously and updated more than once per frame. The timing of how the zones are driven can be considered in the brightness calculation at each grid point in the correction factor grid. Further details of performing a brightness calculation where backlight zones are driven asynchronously can be described with respect to FIG. 5 as follows.

Figure 5:
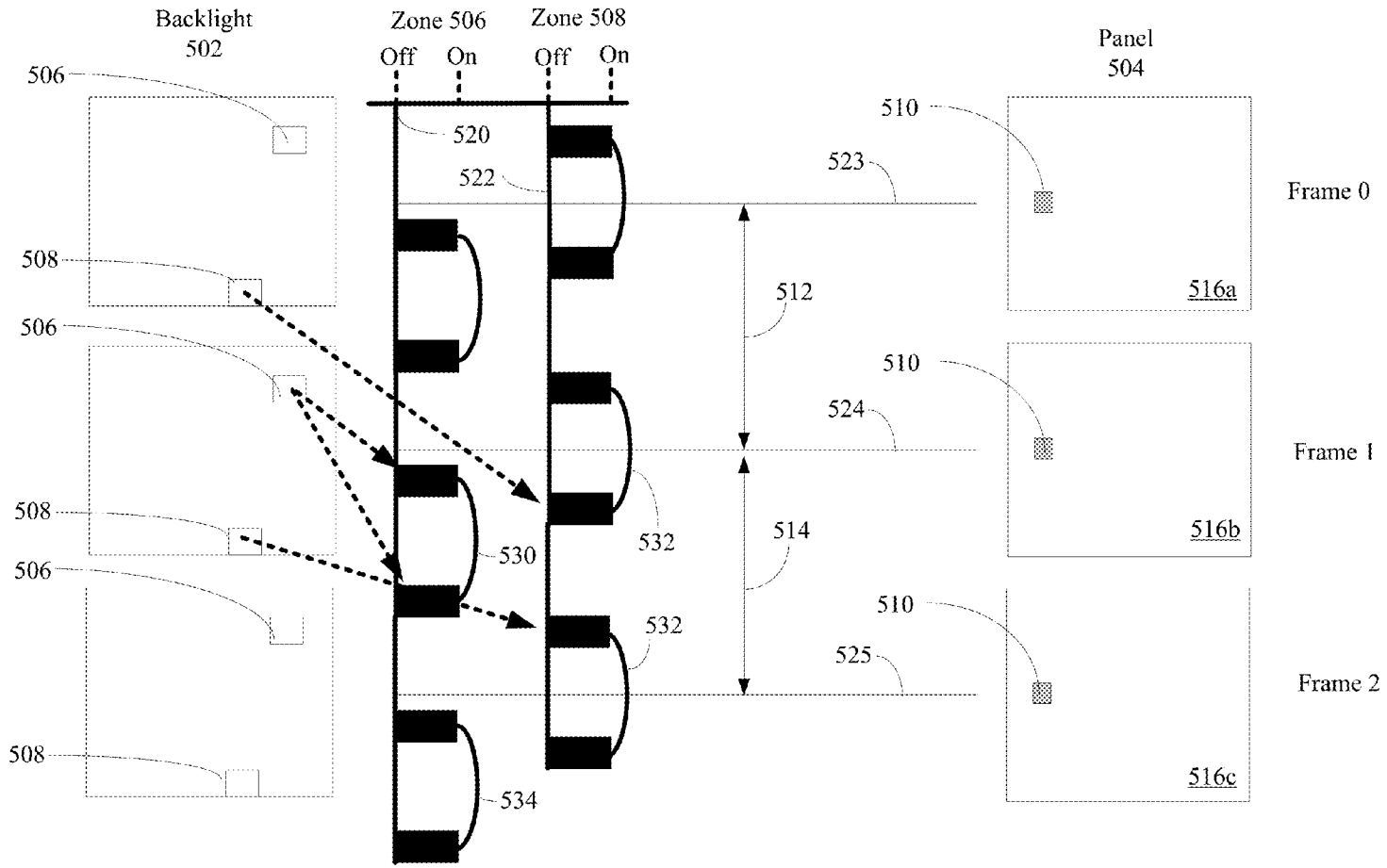
FIG. 5 illustrates timing issues for a light distribution calculation on a correction factor grid for two backlight zones driven asynchronously in accordance with described embodiments.

FIG. 5 illustrates timing issues for a brightness calculation on a correction factor grid for two backlight zones driven asynchronously. Two zones 506 and 508 in backlight 502 are shown. A timing signal including on an off pulses for each zone is shown. In one embodiment, the backlight 502 can receive a signal for updating its brightness setting two or more times for each time the pixels on panel 504 are updated with a correction factor. The timing signal 520 is for zone 506 and the timing signal 522 is for zone 508. It can be seen that the on-off signals for timing signal 520 and 522 are off-set, such that the zones, are being updated with a signal at different times.

Three frames of data, 516*a*, 516*b* and 516*c* are shown, which are also referenced as frame 0, frame 1 and frame 3, respectively. The pixel 510 can change over time based upon the changing image content associated with each of the frames. For instance, pixel 510 can be updated at times, 523, 524 and 525, respectively. A time period 512 is shown between the grid point update times 523 and 524 and a time period 514 is shown between grid point update times 524 and 525. It can be seen in the figure that the updates times for the zones, i.e., when the zones receive a signal can occur at different times than when the frames, such as 516*a*, 516*b* and 516*c* are updated on panel 504.

Pairs of the signals are shown joined to together. The joined signals can represent a zone brightness setting determined from a single frame of data as is described above with respect to FIGS. 3 and 4. The zone brightness setting can vary from joined signal pair to joined signal pair when the image content changes from frame to frame. For instance, for time signal 520 and 522, each of the 3 pairs of signals can be associated with a zone brightness setting determined from frame 0, frame 1 and frame 2, respectively.

In FIG. 5 over time period 514, zone 506's brightness setting can be constant because it is calculated from a signal frame of image data, such as frame 1, represented by the joined signal pair 530 that falls in the time period. However, the contribution from zone 508 may not be constant over the time period 514 because one signal from each two different joined signal pairs, 532 and 534, falls within the time period 514. The two different joined signal pairs, 532 and 534, can be calculated from two different image data frames, such as frame 0 and frame 1. Thus, the brightness setting for zone 508 can change while frame 1 is displayed.

In another example, if the timing of signal 520 were shifted upwards for 506, then both signal pairs 530 and 534 can contribute light during time period 514. The brightness setting for zone 506 associated with signal 530 can be based upon a calculation using frame 1 data while the brightness setting with signal 534 for zone 506 can be based upon a calculation using frame 2 data. Thus, in this example, for each time period during when each frame is displayed, brightness settings calculated from 3 more different frames can be output to the backlight 502. In general, while an image is displayed on the display panel 504, a first zone's brightness setting can be determined from a first frame and a second frame directly following the first frame, a second zone's brightness setting can be determined from only the second frame, and a third zone's brightness setting can be determined from the second frame and a third frame directly following the second frame.

Times, such as 523, 524 and 525, when each image is output to the panel 504 can be tracked. For each zone, based upon its timing off-set relative to when the image data is output, the frame or frames used to determine the brightness setting can be determined during each time period, such as 512 and 514, between when the frame data is updated on panel 504. As described with respect to FIG. 3, the zonal brightness settings can be stored in the zone brightness setting storage 310. Thus, for each zone, a single zonal brightness setting calculated from a single frame or multiple zonal brightness settings calculated from two or more different frames can be used in a grid brightness calculation at each grid point.

Figure 6:
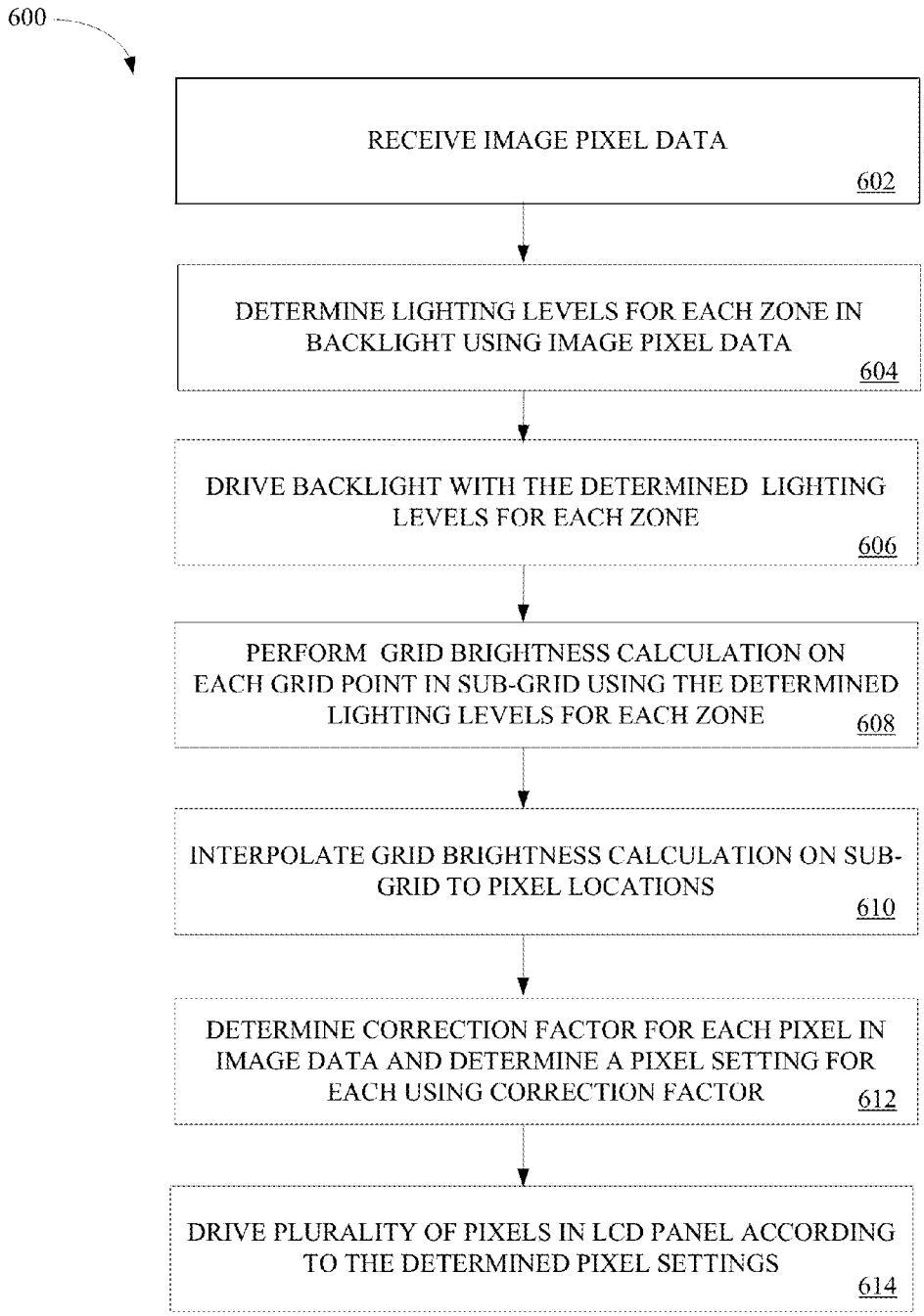
FIG. 6 is a flow chart of a method for controlling a backlight with separately controllable zones and determining a pixel correction factor for image data displayed to an LCD panel.

FIG. 6 is a flow chart of a method 600 for controlling a backlight with separately controllable zones and determining a pixel correction factor for image data displayed to an LCD panel. The backlight for the LCD panel can include a number of light sources, such as a number of LEDs. The LEDs in the backlight can include separately controlled zones where each zone includes one or more of the LEDs. In 602, image data can be received. For example, a controller associated with a display can receive a video signal containing image data, such as a sequence of pixilated frames.

In 604, based upon content contained in the image data, such as the content of a single frame, a zone brightness setting associated with the frame can be determine for each zone in the backlight. The zones of the backlight can be mapped to a frame of the image data. For instance, a frame of the image data can be mapped to a zone control grid. The content of the image data in each zone of the zone control grid can include bright and dark areas. A brightness setting for the zone can be determined based upon a distribution of bright and dark areas in the zone. In particular embodiments, when the image content in a zone is dark or mostly dark, the brightness of a particular zone can be decreased. For example, the brightness of the zone can be decreased by dimming the LEDs in the zone to reduce the amount of light emitted from the zone or selectively turning off one or more of the LEDs in a zone. Dimming the light output in a zone can increase a contrast ratio of an image displayed on the LCD panel and can provide darker dark colors, such as darker blacks.

In 606, each of the zones in the backlight can be driven according to the determined zonal backlight settings. In particular embodiment, the zones can be driven asynchronously to one another. The zones can also be driven asynchronously relative to when the frames used to generate the zonal backlight settings are displayed.

In 608, a grid brightness calculation can be performed at each grid point on a sub-grid. The resolution of the sub-grid can be coarser than the resolution of the pixilated frame data. In one embodiment, the resolution of the sub-grid, such as a maximum x dimension and a maximum y dimension can be set.

The grid brightness calculation can involve determining a light contribution from each zone in the backlight to the light at each grid point over a time period. The time period can be the time that a frame in the image data is displayed. When zones are driven asynchronously, a zone brightness setting in a zone can change while a frame is being displayed. The grid brightness calculation can be modified to account for a change in the light contribution from a particular zone when its brightness changes over a time period for which the grid brightness calculation is used, such as the time period during which a frame is displayed.

In 610, the grid brightness calculation performed on each grid point can provide a value. In one embodiment, a number of the grid calculation can be performed in parallel. The values determined on the sub-grid can interpolated to pixel locations in a frame of pixel data. In one embodiment, linear interpolation using grid point surrounding each pixel locations can be used.

In 612, a correction factor for each pixel in the image data can be determined. The correction factor can be based upon the value of the grid brightness calculation interpolated to each pixel. In one embodiment, correction factor can be calculated from the value of the grid brightness calculation at each pixel location using an inverse table to avoid a divide. The correction factor can used to determine a pixel setting of each pixel so that an average image brightness is maintained when one or more zones of the backlight are dimmed. In 614, the determined pixel settings can be output to an LCD display panel.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a preferred embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

What is claimed is:

1. In a liquid crystal display (LCD) controller, a method for controlling a backlight and a LCD panel comprising a plurality of pixels, the method comprising:

receiving image data comprising a plurality of frames;

determining, using at least the received image data, a lighting level for each of a plurality of zones in the backlight wherein each zone includes one or more light-emitting diodes (LEDs);

driving each of the plurality of zones according to its determined lighting level;

estimating an amount of light from the backlight reaching each of a plurality of grid points, wherein the number of grid points is greater than the number of zones and less than a number of the plurality of pixels, and wherein the estimation at a grid point is calculated based on light received at the grid point from more than one of the plurality of zones, and wherein at least one zone has a first lighting level at a first time during the frame and a second lighting level at a second time during the frame;

determining a pixel setting for each of the plurality of pixels in the LCD panel based upon the estimated amount of light reaching a corresponding one or more grid points; and configuring the LCD panel with the pixel settings to display an image associated with the image data.

2. The method of claim 1, wherein a lighting level of at least one zone is dimmed to improve a contrast ratio of the displayed image.

3. The method of claim 1, further comprising mapping a portion of the image data to each of the plurality of zones and determining the lighting level for each of the plurality of zones using the portion of image data associated with each zone.

4. The method of claim 3, wherein the lighting levels for each of the plurality of zones is determined on a frame by frame basis.

5. The method of claim 1, further comprising interpolating from the estimated amount of light reaching the corresponding one or more grid points to determine an estimated amount of light reaching each of the plurality of pixels.

6. The method of claim 1, wherein for each grid point, the estimated amount of light reaching the grid point is generated as a summation of contributions of an amount of light emitted from each of the plurality of zones in the backlight.

7. The method of claim 1, wherein the estimation of the amount of light reaching each of the grid points is performed for a plurality of different grid point simultaneously.

8. The method of claim 1, wherein the plurality of zones are driven asynchronously such that the lighting levels for each of the plurality of zone are updated at different times.

9. The method of claim 1, wherein over a time period in which a single frame of image data is displayed, a lighting level for one of the plurality of zones is determined from a frame of image data different than the single frame of image data.

10. An apparatus for displaying images comprising:

an LCD panel comprising a plurality of pixels for displaying the images;

an LED backlight including a plurality of zones for illuminating the LCD panel wherein each of the plurality of zones includes one or more LEDs; and a controller, coupled to the LCD panel and the LED backlight, designed or configured to 1) receive image data comprising a plurality of frames;
2) determine, using at least the received image data, a lighting level for each of a plurality of zones in the backlight;
3) drive each of the plurality of zones according to its determined lighting level;
4) estimate an amount of light from the backlight reaching each of a plurality of grid points, wherein the number of grid points is greater than the number of zones and less than a number of the plurality of pixels, and wherein the estimation at a grid point is calculated based on light received at the grid point from more than one of the plurality of zones, and wherein at least one zone has a first lighting level at a first time during the frame and a second lighting level at a second time during the frame;
5) determine a pixel setting for each of the plurality of pixels in the LCD panel based upon the estimated amount of light reaching a corresponding one or more grid points; and
6) configuring the LCD panel with the pixel settings to output the displayed images associated with the image data.

11. The apparatus of claim 10, wherein the apparatus is configured as a flat panel television.

12. The apparatus of claim 10, further comprising: a memory for storing data indicating how an intensity of light diminishes as a function of distance from a location in each zone.

13. The apparatus of claim 10, wherein a lighting level of at least one zone is dimmed to improve a contrast ratio of the displayed images.

14. The apparatus of claim 10, wherein the controller is further designed or configured to map a portion of each frame of the image data to each of the plurality of zones and determine the lighting level for each of the plurality of zones using the portion of each frame mapped to each zone.

15. The apparatus of claim 10, wherein the estimated amount of light reaching each grid point is based upon a summation of an amount of light reaching the grid point from each zone.

16. An integrated circuit comprising:

a zone brightness setting determiner block, arranged to receive image data and determine, using at least the received image data, a lighting level for each of a plurality of zones in a backlight of an LCD panel;

a grid brightness calculator block, arranged to estimate an amount of light from the backlight reaching each of a plurality of grid points, wherein the number of grid points is greater than the number of zones and less than a number of a plurality of pixels in the LCD panel, and wherein the estimation at a grid point is calculated based on light received at the grid point from more than one of the plurality of zones, the grid brightness calculator block arranged to calculate estimations for a first grid point and a second grid point in parallel; and a processor in communication with the zone brightness setting determiner block and the grid brightness calculator block, the processor arranged to improve a contrast ratio of image displayed on the LCD panel by determining a lighting level for a plurality of LEDs in the backlight and by determining a light-field generated from the backlight at each pixel location of the LCD panel based upon the estimated amount of light reaching a corresponding one or more grid points.

* * * * *